US005935047A

United States Patent [19]

Cawley

[11] Patent Number: 5,935,047

[45] Date of Patent: Aug. 10, 1999

[54] LOWER LEG EXERCISE DEVICE

[76] Inventor: James D. Cawley, 562 W. Washington St., Bradford, Pa. 16701

[21] Appl. No.: 08/920,771

[22] Filed: Aug. 29, 1997

[51] Int. Cl.[6] ..... A63B 23/08; A63B 21/065

[52] U.S. Cl. ..... 482/79; 482/104; 482/105; 36/132

[58] Field of Search ..... 482/79, 80, 92, 482/93, 97, 108, 104–106, 144, 145; 601/27; 36/132, 136, 7.6, 7.7, 82, 105

[56] References Cited

U.S. PATENT DOCUMENTS

| | | | |
|---|---|---|---|
| 757,983 | 4/1904 | Vaile | 482/105 |
| 1,059,284 | 4/1913 | Dennis | 36/7.6 |
| 1,671,096 | 5/1928 | Anderson | 482/79 |
| 1,990,970 | 2/1935 | Wood | 482/105 |
| 2,114,790 | 4/1938 | Venables | 482/105 |
| 2,214,052 | 9/1940 | Good | 482/105 |
| 2,424,159 | 7/1947 | Goetz | 482/105 |
| 3,343,836 | 9/1967 | James, Jr. | 482/105 |
| 3,421,760 | 1/1969 | Freeman, Jr. | 482/80 |
| 4,523,582 | 6/1985 | Barber | 482/144 |
| 5,169,364 | 12/1992 | Donaldson | 482/105 |
| 5,267,927 | 12/1993 | Catanzano et al. | 482/105 |

FOREIGN PATENT DOCUMENTS

| | | | |
|---|---|---|---|
| 1491589 | 11/1969 | Germany | 482/79 |
| 609109 | 9/1948 | United Kingdom | 482/80 |
| 830606 | 3/1960 | United Kingdom | 482/105 |

*Primary Examiner*—Richard J. Apley
*Assistant Examiner*—Victor K. Hwang

[57] ABSTRACT

The present invention relates to an exercise device which is designed to be worn on the foot of a user. The device is specifically adapted to work in conjunction with a barbell type weight which can be placed upon the device by way of a pair of weight supports. Thus, in its broadest context the present invention includes a footboard which is adapted to be worn on the foot of a user, and a pair of barbell weight supports. The device further includes various straps for securing the footboard to a users' foot.

1 Claim, 2 Drawing Sheets

62
34
22
24
42
28
38
44
54
4
4
46
52
32
64
26
48

22
34
54
36
37

LOWER LEG EXERCISE DEVICE

BACKGROUND OF THE INVENTION

1. Field of the Invention

The present invention relates to a lower leg exercising device and more particularly pertains to such a device adapted to be worn on a user's foot.

2. Description of the Prior Art

The use of exercise shoes for exercising the foot are known in the prior art. More specifically, exercise shoes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,955,370 to Pettine discloses an achilles tendon rehabilitation brace. U.S. Pat. No. 4,951,938 to Smith IV discloses an exercise shoe construction. U.S. Design Pat. No. 340,123 to Howey Jr. discloses the design of a walking assistance attachment for snow ski boots. U.S. Pat. No. 4,821,432 to Reiber discloses a walking adapted for postsurgical shoes. U.S. Pat. No. 4,206,558 to Bivona discloses an exercise shoe for simulated jogging. U.S. Pat. No. 4,526,365 to Ziegelbaum discloses an exercising device suitable for physical therapy.

In this respect, the lower leg exercising device substantially departs from the conventional concepts and designs of the prior art, and in so doing provides an apparatus primarily developed for the purpose of exercising the lower leg.

Therefore, it can be appreciated that there exists a continuing need for improved devices for exercising the muscles of the lower leg. In this regard, the present invention substantially fulfills this need.

SUMMARY OF THE INVENTION

In view of the foregoing disadvantages inherent in the known types of foot exercising devices now present in the prior art, the present invention provides an exercising device adapted to be worn on the foot. As such, the general purpose of the present invention, which will be described subsequently in greater detail, is to provide a foot exercising device which works in conjunction with barbell type weights.

To attain this, the present invention essentially comprises an exercise device which is designed to be worn on the foot of a user. The device is specifically adapted to work in conjunction with a barbell type weight which can be placed upon the device by way of a pair of weight supports. Thus, in its broadest context the present invention includes a footboard which is adapted to be worn on the foot of a user, and a pair of barbell weight supports. The device further includes various straps for securing the footboard to a users' foot.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved leg exercising device for use in conjunction with a barbell type weight and adapted to be worn on a user's foot. The device includes a footboard having a first side, second side, rearward extent, a forward extent, an upper surface and a lower surface, and a peripheral edge extending between the upper and lower surfaces. A rubber texturized non-slip surface is secured to the lower surface of the footboard, and an aperture is formed within the peripheral edge of the footboard at the rearward extent. A first weight support is secured to the first side of the footboard. The first weight support has a forward end and a arcuate rearward end, the forward end is secured to the first side upper surface of the footboard by way of a set of screws. The arcuate rearward end of the weight support is adapted to support a barbell type weight. Similarly, a second weight support is secured to the second side of the footboard. The second weight support has a forward end and a arcuate rearward end. The forward end is secured to the second side upper surface of the footboard by way of a set of screws. The arcuate rearward end of the weight support is adapted to support a barbell type weight. A leg strap retainer is employed and defined by a first end, a second end and an intermediate therebetween. The first end of the leg strap retainer is secured within the aperture of the footboard. The second end of the leg strap retainer extends above the upper surface of the footboard. An ankle strap is also employed and defined by a first end, a second end, and an intermediate extent therebetween. The first end and second end each have mating VELCRO hook and loop surfaces formed thereon. The intermediate extent of the ankle strap is secured to the second end of the leg strap retainer. Additionally, an ankle pad is included and defined by a first end, a second end and an intermediate extent therebetween. The first end of the ankle pad is secured to the intermediate extent of the ankle strap proximate the first end, and the second end of the ankle pad is secured to the intermediate extent of the ankle strap proximate the second end. A first foot strap is defined by a first end secured to the peripheral edge of the footboard at the first side, and a second end with a VELCRO surface secured thereon. A second foot strap is likewise defined by a first end secured to the peripheral edge of the footboard at the second side, and a second end with a VELCRO surface secured thereon. The second end of the first strap is adapted to be releasably secured to second end of the second strap.

It is another object of the present invention to provide an exercise device with multiple straps for use in securing the device to a users foot.

It is a further object of the present invention to provide an exercise device for the lower leg, which works in conjunction with weights of various sizes.

An even further object of the present invention is to provide a lower leg exercising device which is susceptible of a low cost of manufacture with regard to both materials and labor, and which accordingly is then susceptible of low prices of sale to the consuming public, thereby making such lower leg exercising device economically available to the buying public.

Still yet another object of the present invention is to provide a lower leg exercising device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

The present invention relates to an exercise device which is designed to be worn on the foot of a user. The device is specifically adapted to work in conjunction with a barbell type weight which can be placed upon the device by way of a pair of weight supports. Thus, in its broadest context the present invention includes a footboard which is adapted to be worn on the foot of a user, and a pair of barbell weight supports. The device further includes various straps for securing the footboard to a users' foot. The various components of the present invention, and the manner in which they interrelate, will be described in greater detail hereinafter.

Figure 1:
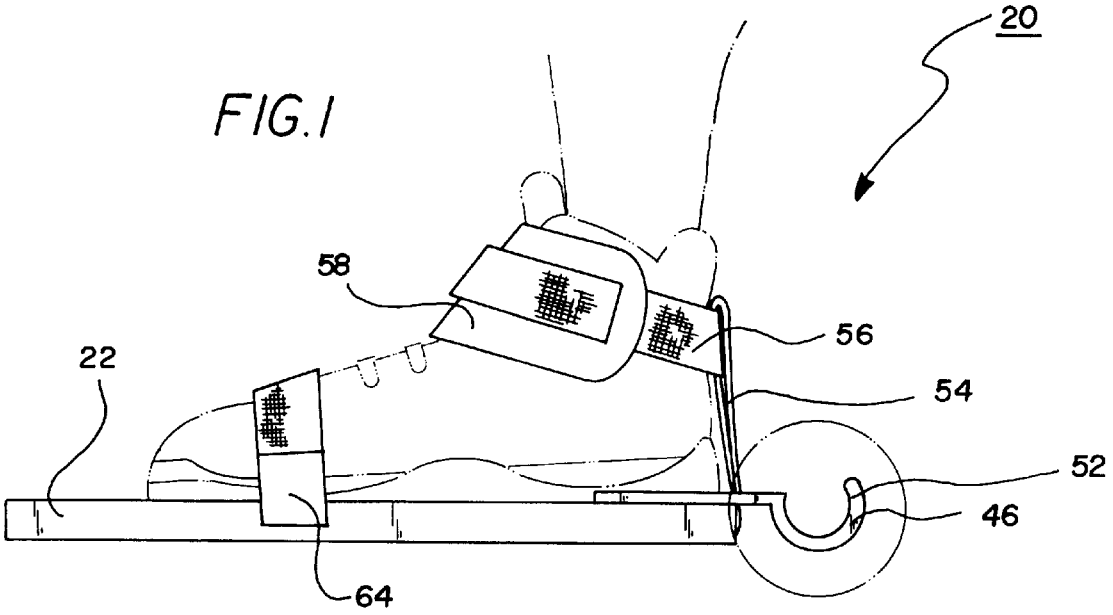
FIG. 1 is a side elevational view of the device in use on a user's foot.
Figure 2:
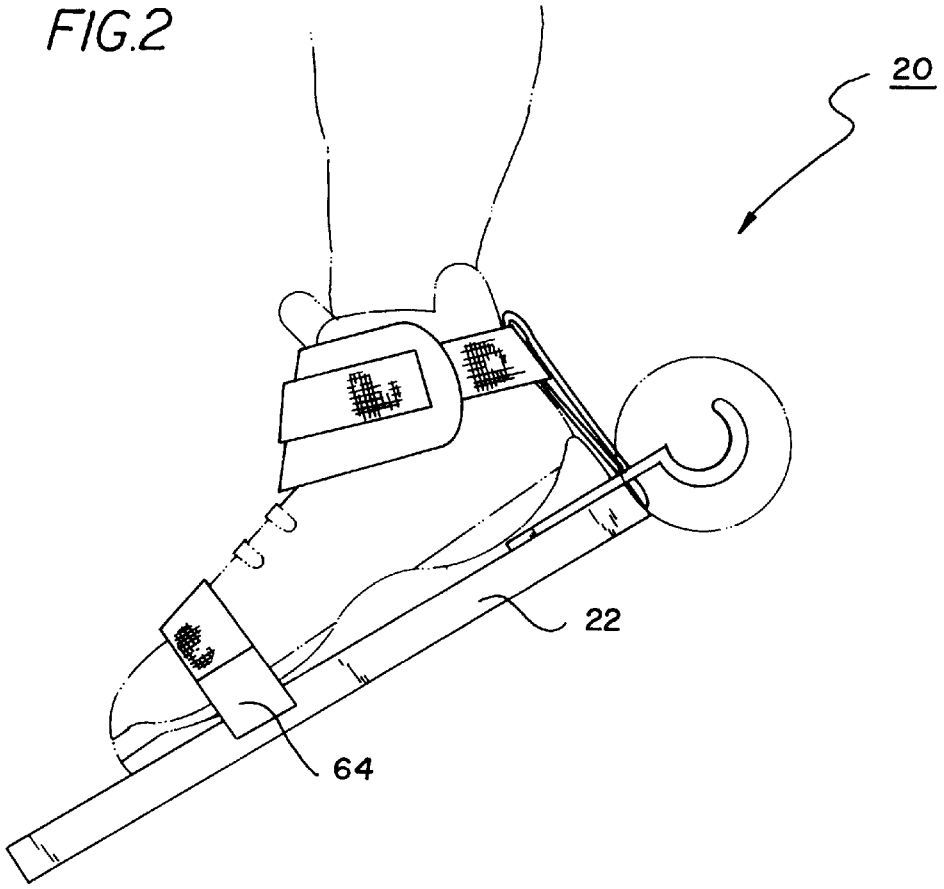
FIG. 2 is a side view of the user performing a lower leg exercise.
Figure 4:
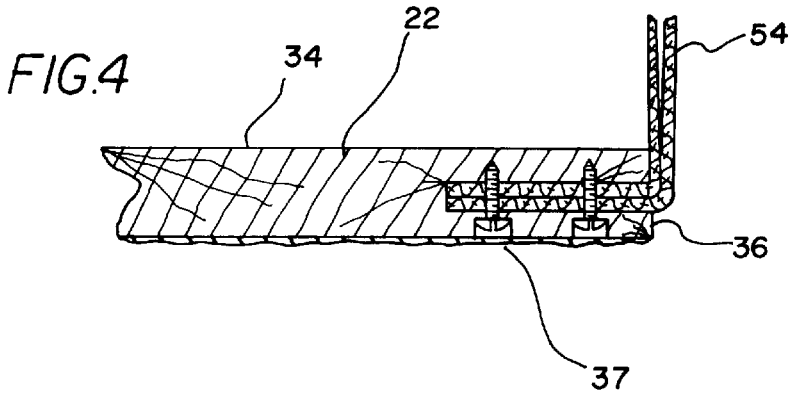
FIG. 4 sectional view taken along line 4—4 of FIG. 3.

The leg exercising device 20 is adapted for use on a user's foot as depicted in FIGS. 1 and 2. Although only one such exercising device 20 is currently being described two such devices could be employed, one on either foot. The footboard 22 is the first component of the invention. The footboard 22 is defined by a first side 24, second side 26, rearward extent 28, a forward extent 32, an upper surface 34 and a lower surface. The footboard can be constructed from a hard molded plastic. Additionally, a peripheral edge 36 extends between the upper 34 and lower surfaces. In the preferred embodiment, a rubber textured non-slip surface 37 is secured to the lower surface of the footboard 22. With reference to FIG. 4, an aperture is formed within the peripheral edge 36 of the footboard 22 at the rearward extent 28. The function of this aperture will be described in greater detail hereinafter.

Figure 3:
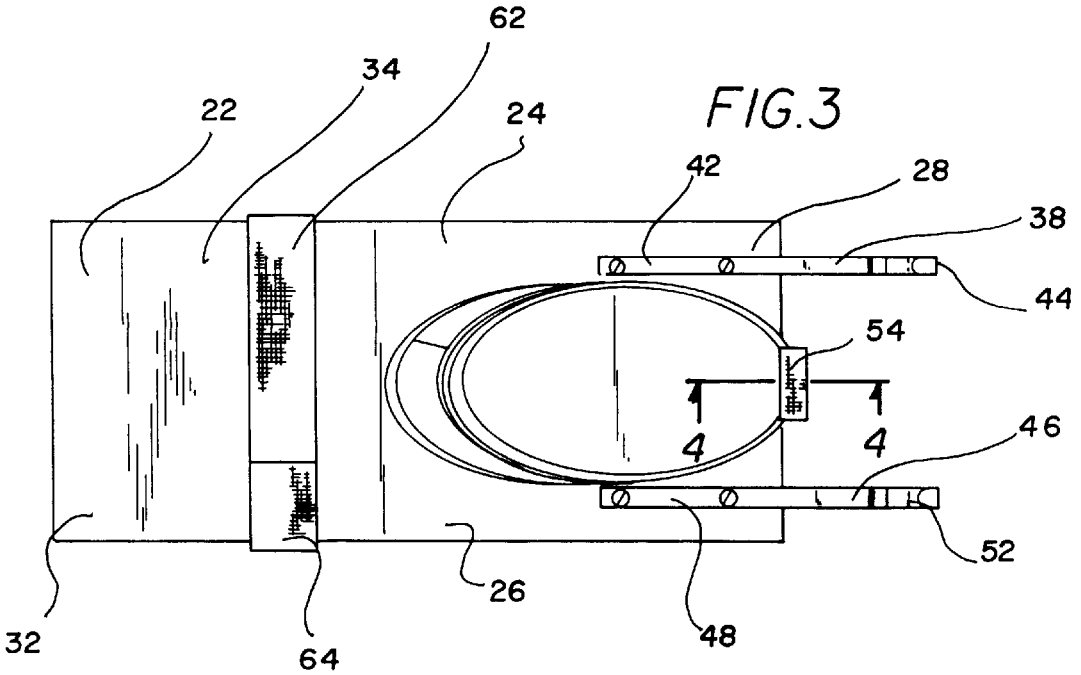
FIG. 3 is a plan view of the exercising device of the present invention.

A first weight support 38 is secured to the first side of the footboard. The first weight support 38 is defined by a forward end 42 and a arcuate rearward end 44. The forward end 42 is secured to the first side 24 upper surface 34 of the footboard 22 by way of a set of screws. This securement is illustrated in FIG. 3. The arcuate rearward end 44 of the weight support 38 is adapted to support a barbell type weight.

Likewise, a second weight support 46 is secured to the second side 26 of the footboard 22. The second weight support 46 is defined by a forward end 48 and a arcuate rearward end 52. The forward end 48 is secured to the second side 26 upper surface 34 of the footboard 22 by way of a set of screws. The arcuate rearward end 44 of the weight support 46 is adapted to support a barbell type weight.

The footboard 22 is secured to a user's foot by way of leg straps and ankle straps. Additionally, a leg strap retainer is secured to the device. The leg strap retainer 54 has a first end, a second end and an intermediate therebetween. The first end of the leg strap retainer 54,in the preferred embodiment, is secured within the aperture of the footboard 22. The securement can be achieved by way of a pair of screws recessed in the bottom of the footboard 22. Such a configuration is depicted in FIG. 4. The second end of the leg strap retainer 54 extends above the upper surface of the footboard 22.

The ankle strap 56 is defined by a first end, a second end, and an intermediate extent therebetween. The first end and second end of the ankle strap 56 each have mating VELCRO hook and loop surfaces formed thereon. In this manner, the two ends of the ankle strap 56 can be secured to one another. Additionally, the intermediate extent of the ankle strap 56 is secured to the second end of the leg strap retainer 54. More specifically, the intermediate length of the ankle strap 56 is threaded through a loop formed within the leg strap retainer 54.

Additionally, as a means of protecting a user's ankle, an ankle pad 58 is secured to the ankle strap. This ankle pad 58 includes a first end, a second end and an intermediate extent therebetween. In the preferred embodiment, the ankle pad 58 is formed from a soft cloth material. The first end of the ankle pad 58 is secured to the intermediate extent of the ankle strap 56 proximate the first end. Likewise, the second end of the ankle pad 58 is secured to the intermediate extent of the ankle strap 56 proximate the second end. These securements can be achieved by way of slots formed through the ends of the pad. Thus, the ankle strap 56 can be threaded through these slots, thereby securing the pad 58 to the strap 56.

The first foot strap 62 includes a first end secured to the peripheral edge 36 of the footboard 22 at the first side 24, and a second end with a VELCRO surface secured thereon. Likewise, the second foot strap 64 includes a first end secured to the peripheral edge 36 of the footboard 22 at the second side 26, and a second end with a VELCRO surface secured thereon, the second end of the first strap. Thus, the second ends of the foot straps 62 and 64 can be releasably secured to one another by way of their VELCRO surfaces.

In use, the user secures the device to his or her foot. This is achieved by securing the ankle straps about their ankle and the foot straps over their feet. In this configuration, the user's foot bottom should touch the upper surface of the footboard. Next, a barbell type weight is placed within the arcuate portion of the weight holders. The user is now ready to perform various ankle and or calf strengthing exercises.

The exercise device of the present invention, or lower leg exerciser is a specially designed support for the heel and ball of the foot during lower leg exercises. It helps develop posterior and anterior calf muscles, while also strengthening the achilles tendon. The lower leg exercise is adapted to be strapped to the sole of the shoe or foot. Made with a hard, molded plastic foot board measuring approximately 14 inches long and 6 inches wide, the lower leg exerciser has a rubber non skid surface on the bottom to prevent slipping. It also features three nylon or leather straps, two of which loop around the users ankles and the other is wrapped around near the toes. The straps are secure through the use of VELCRO strips two strong metal hooks located on one end of the platform can be used to hold small hand weights.

The main goal of the lower leg exerciser is that the product isolates the ankle joint action/motion, making the exercises single joint motions. The board is good because it allows one to move and flex the ankle, yet forces one to keep their toes straight and foot flat. Thus, one cannot cheat by using the muscles in the toes or feet to raise or lower the weight. One is forced to use the ankle joint, as is intended and proper in these exercises.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A leg exercising device for use in conjunction with a barbell type weight and adapted to be worn on a user's foot, the device comprising:

a footboard having a first side, second side, rearward extent, a forward extent, an upper surface and a lower surface, a peripheral edge extending between the upper and lower surfaces, a rubber textured non-slip surface secured to the lower surface of the footboard, an aperture formed within the peripheral edge of the footboard at the rearward extent;

a first weight support secured to the first side of the footboard, the first weight support having a forward end and an arcuate rearward end, the forward end being secured to the first side upper surface of the footboard by way of a set of screws, the arcuate rearward end of the weight support adapted to support a barbell type weight;

a second weight support secured to the second side of the footboard, the second weight support having a forward end and an arcuate rearward end, the forward end being secured to the second side upper surface of the footboard by way of a second set of screws, the arcuate rearward end of the weight support adapted to support a barbell type weight;

whereby the first and second weight supports hold a single barbell type weight with a bar extending between the respective arcuate rearward ends with opposing weights on the barbell disposed outside of arcuate rearward ends;

a leg strap retainer having a first end, a second end and an intermediate extent therebetween, the first end of the leg strap retainer being secured within the aperture of the footboard, the second end of the leg strap retainer extending above the upper surface of the footboard in the form of a loop;

an ankle strap having a first end, a second end, and an intermediate extent therebetween, the first end and second end each having mating hook and loop surfaces formed thereon, the intermediate extent of the ankle strap being coupled with the loop of the leg strap retainer;

an ankle pad having a first end, a second end and an intermediate extent therebetween, the first end of the ankle pad secured to the intermediate extent of the ankle strap proximate the first end, the second end of the ankle pad secured to the intermediate extent of the ankle strap proximate the second end;

a first foot strap having a first end secured to the peripheral edge of the footboard at the first side, and a second end with a hook and loop surface secured thereon;

a second foot strap having a first end secured to the peripheral edge of the footboard at the second side; and a second end with a hook and loop surface secured thereon, the second end of the first strap adapted to be releasably secured to the second end of the second strap.

* * * * *